US009064465B2

(12) United States Patent
Huang et al.

(10) Patent No.: US 9,064,465 B2
(45) Date of Patent: Jun. 23, 2015

(54) HOMOCHROMATIC AND COLOR DISPLAY ASSEMBLY ON AN ELECTRONIC DEVICE AND METHOD FOR OPERATION THEREOF

(75) Inventors: Jie Huang, Tianjin (CN); Weng Woh Khor, Singapore (SG)

(73) Assignee: Google Technology Holdings LLC, Mountain View, CA (US)

( * ) Notice: Subject to any disclaimer, the term of this patent is extended or adjusted under 35 U.S.C. 154(b) by 1165 days.

(21) Appl. No.: 12/116,335

(22) Filed: May 7, 2008

(65) Prior Publication Data

US 2008/0284718 A1 Nov. 20, 2008

(30) Foreign Application Priority Data

May 18, 2007 (CN) ..... 2007 1 0105002

(51) Int. Cl.
*G09G 3/36* (2006.01)
*G09G 3/34* (2006.01)

(52) U.S. Cl.
CPC ..... *G09G 3/3611* (2013.01); *G09G 3/3406* (2013.01); *G09G 2330/021* (2013.01); *G09G 2360/144* (2013.01)

(58) Field of Classification Search
CPC ..... G09G 3/36; G09G 3/3611; G09G 3/3406; G09G 2330/021; G09G 2360/144; G09G 2320/0646; G09G 2360/16
USPC ..... 345/4–6, 102, 207
See application file for complete search history.

(56) References Cited

U.S. PATENT DOCUMENTS 5,600,459 A * 2/1997 Roy et al. ..... 349/42
7,495,649 B2 * 2/2009 Lowles et al. ..... 345/102
7,746,303 B2 * 6/2010 Cernasov et al. ..... 345/88
8,068,125 B2 * 11/2011 Pantfoerder ..... 345/690
2003/0117364 A1 * 6/2003 Miyake ..... 345/102
2006/0244702 A1 * 11/2006 Yamazaki et al. ..... 345/89
2006/0268197 A1 * 11/2006 Valliath et al. ..... 349/96
2007/0063925 A1 * 3/2007 Yoshihara et al. ..... 345/4
2007/0242028 A1 * 10/2007 Kitagawa et al. ..... 345/100
2007/0242186 A1 * 10/2007 Ikeno et al. ..... 349/74

FOREIGN PATENT DOCUMENTS

CN 101036180 9/2007

OTHER PUBLICATIONS

Chinese Application No. 200710105002.7, Office Action issued Feb. 26, 2010, 7 pages.

* cited by examiner

*Primary Examiner* — Towfiq Elahi
(74) *Attorney, Agent, or Firm* — Blakely Sokoloff Taylor & Zafman LLP

(57) ABSTRACT

The present invention provides an electronic device (100) comprising a homochromatic liquid crystal display (155), a color liquid crystal display (165), and a backlight (175) having a light-pipe (220), the homochromatic liquid crystal display, the color liquid crystal display and the light-pipe being positioned in overlapping relation to each other, the light-pipe arranged to direct light (230*d*) through both the homochromatic liquid crystal display and the color liquid crystal display, a homochromatic liquid crystal display driver (150) arranged to generate an image on the homochromatic liquid crystal display in response to an image signal, a color liquid crystal display driver (160) arranged to generate an image on the color liquid crystal display in response to an image signal, a processor (103) arranged to receive a light control signal (LS1), and to forward an image signal to one of the homochromatic liquid crystal display driver or the color liquid crystal display driver dependent on the light control signal.

14 Claims, 4 Drawing Sheets

HOMOCHROMATIC AND COLOR DISPLAY ASSEMBLY ON AN ELECTRONIC DEVICE AND METHOD FOR OPERATION THEREOF

FIELD OF THE INVENTION

The present invention relates generally to the field of display screens on electronic devices; and especially though not exclusively to liquid crystal displays.

BACKGROUND OF THE INVENTION

Liquid crystal displays (LCDs) are typically employed for display screens in electronic devices because of their low power usage. LCDs can be provided in both homochromatic (also known as monochromatic, black and white, or greyscale) and color, with color LCDs including additional color filters for each pixel as will be appreciated by those skilled in the art. Current color LCDs typically provide in excess of 16.8 million colors per pixel at a resolution of 1024×768 for computer notebook display screens, and 64,000 colors at a resolution of 320×320 for mobile phone and PDA (personal digital assistant) display screens. However such color LCDs require additional power consumption which reduces battery life in battery powered electronic devices. A further problem with color LCDs is that they can be difficult to view outside, or in other high ambient lighting conditions such as direct sunlight, sunlight through a window, or overhead indoor lighting.

SUMMARY OF THE INVENTION

According to one aspect of the invention there is provided an electronic device comprising: a homochromatic liquid crystal display, a color liquid crystal display, and a backlight having a light-pipe; the homochromatic liquid crystal display, the color liquid crystal display and the light-pipe being positioned in overlapping relation to each other, the light-pipe arranged to direct light through both the homochromatic liquid crystal display and the color liquid crystal display; a homochromatic liquid crystal display driver arranged to generate an image on the homochromatic liquid crystal display in response to an image signal; a color liquid crystal display driver arranged to generate an image on the color liquid crystal display in response to an image signal; a processor arranged to receive a light control signal, and to forward an image signal to one of the homochromatic liquid crystal display driver or the color liquid crystal display driver dependent on the light control signal.

According to another aspect of the invention there is provided a method of operating a display assembly of an electronic device, the method comprising: measuring a level of ambient light at the device; and generating an image on the display assembly, the image being homochromatic or color dependent on the level of ambient light.

BRIEF DESCRIPTION OF THE DRAWINGS

In order that the invention may be readily understood and put into practical effect, reference will now be made to an exemplary embodiment as illustrated with reference to the accompanying figures, where like reference numerals refer to identical or functionally similar elements throughout the separate views. The figures together with a detailed description below, are incorporated in and form part of the specification, and serve to further illustrate the embodiments and explain various principles and advantages, in accordance with the present invention where.

Figure 1:
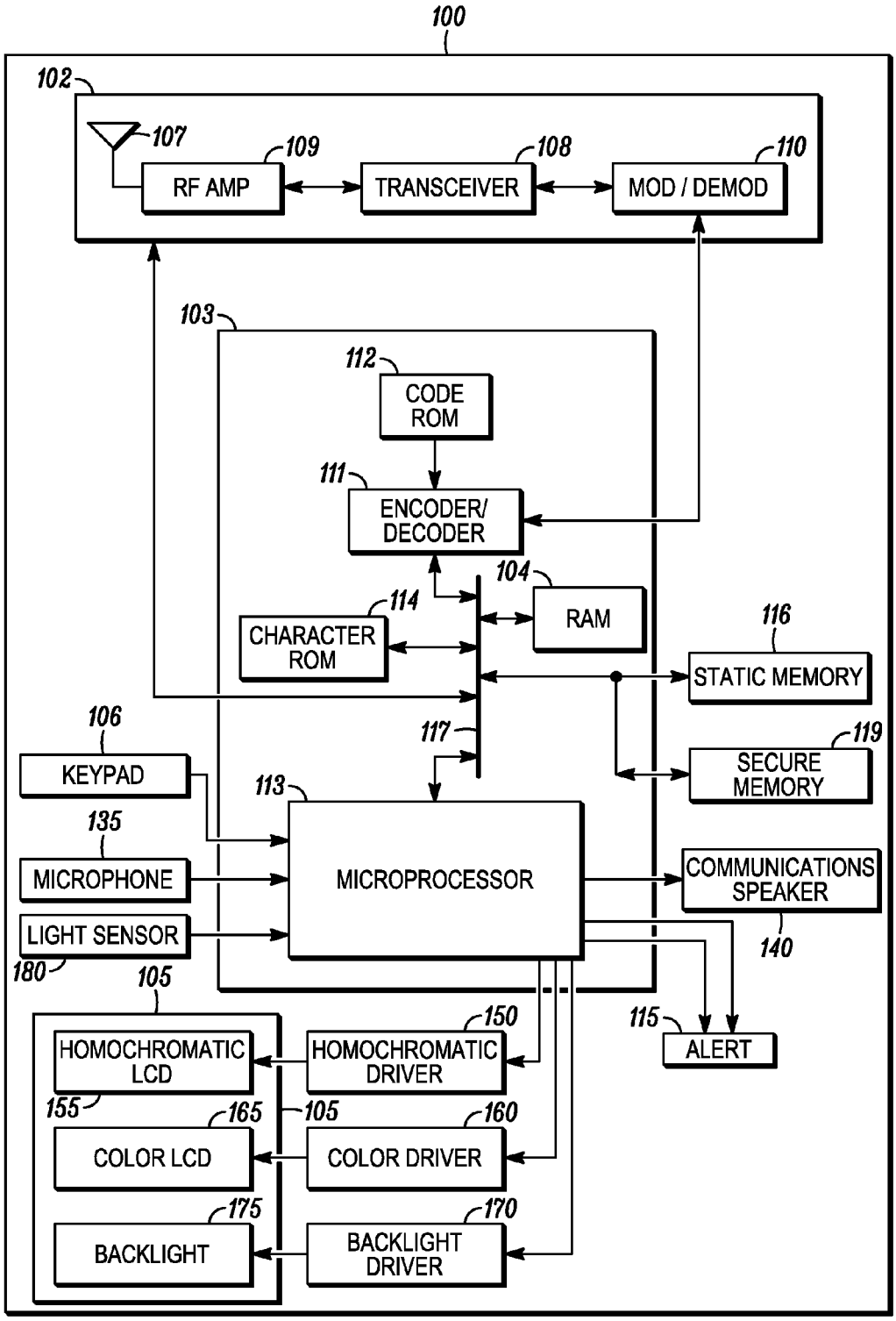
FIG. 1 is a schematic block diagram illustrating circuitry of an electronic device in accordance with an embodiment of the invention.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present invention.

DETAILED DESCRIPTION

Before describing in detail embodiments that are in accordance with the present invention, it should be observed that the embodiments reside primarily in combinations of method steps and device components related to displaying homochromatic or color images dependent on a light control signal. Accordingly, the device components and method steps have been represented where appropriate by conventional symbols in the drawings, showing only those specific details that are pertinent to understanding the embodiments of the present invention so as not to obscure the disclosure with details that will be readily apparent to those of ordinary skill in the art having the benefit of the description herein.

In this document, relational terms such as first and second, top and bottom, and the like may be used solely to distinguish one entity or action from another entity or action without necessarily requiring or implying any actual such relationship or order between such entities or actions. The terms "comprises," "comprising," or any other variation thereof, are intended to cover a non-exclusive inclusion, such that a method or device that comprises a list of elements does not include only those elements but may include other elements not expressly listed or inherent to such a method or device. An element proceeded by "comprises . . . a" does not, without more constraints, preclude the existence of additional identical elements in the method or device that comprises the element. Also, throughout this specification the term "key" has the broad meaning of any key, button or actuator having a dedicated, variable or programmable function that is actuatable by a user.

It will be appreciated that embodiments of the invention described herein may be comprised of one or more conventional processors and unique stored program instructions that control the one or more processors to implement, in conjunction with certain non-processor circuits, some, most, or all of the functions of displaying homochromatic or color images dependent on a light control signal described herein. The non-processor circuits may include, but are not limited to, a radio receiver, a radio transmitter, signal drivers, clock circuits, power source circuits, and user input devices. As such, these functions may be interpreted as steps of a method for displaying homochromatic or color images dependent on a light control signal. Alternatively, some or all functions could be implemented by a state machine that has no stored program instructions, or in one or more application specific integrated circuits (ASICs), in which each function or some combinations of certain of the functions are implemented as custom logic. Of course, a combination of the two approaches could be used. Thus, methods and means for these functions have been described herein. Further, it is expected that one of ordinary skill, notwithstanding possibly significant effort and many design choices motivated by, for example, available time, current technology, and economic considerations, when guided by the concepts and principles disclosed herein will be readily capable of generating such software instructions and programs and ICs with minimal experimentation.

Referring to FIG. 1, there is a schematic diagram illustrating an electronic device 100 such as a wireless communications device in the form of a mobile station or mobile telephone comprising a radio frequency communications unit 102 coupled to be in communication with a processor 103. Alternatively the electronic device may be designed primarily for personal digital assistant (PDA), digital audio and/or video functions with or without wireless communications functions.

The electronic device 100 also has a display assembly 105 which may include a touch sensitive screen for receiving user data entry or function operation instructions from a user of the device. The display assembly 105 comprises a homochromatic liquid crystal display (LCD) 155, a color liquid crystal display (LCD) 165, and a backlight 175. The electronic device 100 also comprises a homochromatic liquid crystal display driver 150 for driving the homochromatic liquid crystal display 155, a color liquid crystal display driver 160 for driving the color liquid crystal display 165, and a backlight driver 170 for driving the backlight 175. These three drivers 150, 160, 175 are operatively coupled to the processor 103. The homochromatic liquid crystal display driver 150 is arranged to generate an image on the homochromatic liquid crystal display 155 in response to an image signal from the processor 103. Similarly the color liquid crystal display driver 160 is arranged to generate an image on the color liquid crystal display 165 in response to an image signal from the processor 103. The image signal is generated by the processor 103 as will be appreciated by those skilled in the art, and forwarded to one of the homochromatic LCD driver 150 or the color LCD 160. The processor 103 may also control the backlight 175 using a suitable control signal to the backlight driver 170 as will be appreciated by those skilled in the art. Whilst the homochromatic LCD driver 150, the color LCD driver 160, and the backlight driver 170 have been shown as separate hardware components for simplicity, the functionality of these components may in fact be implemented by the processor 103, for example by executing suitable software stored on the electronic device 100.

There is also an alert module 115 that typically contains an alert speaker, vibrator motor and associated drivers. The alert module 115 is coupled to be in communication with the processor 103. The electronic device also has a keypad 106 containing a number of keys which may be actuated by a user of the device in order to enter user data or operate certain functions of the device.

The processor 103 is operatively coupled to various memory components and includes an encoder/decoder 111 with an associated code Read Only Memory (ROM) 112 for storing data for encoding and decoding voice or other signals that may be transmitted or received by the electronic device 100. The processor 103 also includes a micro-processor 113 coupled, by a common data and address bus 117, to the radio frequency communications unit 102, the encoder/decoder 111, a character Read Only Memory (ROM) 114, a Random Access Memory (RAM) 104, static programmable memory 116 and a Secure Memory 119. The secure memory 119 may be a subscriber identity card (SIM or RUIM) in a subscriber card based mobile phone for example. The static programmable memory 116 and a secure memory 119 may store, amongst other things, Preferred Roaming Lists (PRLs), subscriber authentication data, selected incoming text messages and a Telephone Number Database (TND phonebook) comprising a number field for telephone numbers and a name field for identifiers associated with one of the numbers in the name field. The secure memory 119 and static memory 116 may also store passwords for allowing accessibility to password-protected functions on the mobile telephone 100. Further the secure memory may securely store secret shared data for use in communicating with a wireless network.

The micro-processor 113 has ports for coupling to the display assembly drivers 150, 160, 170, the alert module 115 and the keypad 106. Also, micro-processor 113 has ports for coupling to a microphone 135 and a communications speaker 140 that are integral with the device.

The character Read Only Memory 114 stores code for decoding or encoding text messages that may be received by the communications unit 102. In this embodiment the character Read Only Memory 114, RUIM card 119, and static memory 116 may also store Operating Code (OC) for the micro-processor 113 and code for performing functions associated with the mobile telephone 100.

The radio frequency communications unit 102 is a combined receiver and transmitter having a common antenna 107. The communications unit 102 has a transceiver 108 coupled to the antenna 107 via a radio frequency amplifier 109. The transceiver 108 is also coupled to a combined modulator/demodulator 110 that couples the communications unit 102 to the processor 103.

The electronic device 100 also comprises a light sensor 180 which is located at an external face of the device, typically adjacent the screen or external viewing surface of the display assembly 105. The light sensor 180 receives ambient light incident on or near the external or viewing surface of the display assembly 105. The light sensor 180 generates a light control signal LS1 in response to ambient light incident on the light sensor 180. The light control signal LS1 is dependent on the level of ambient light incident on the light sensor 180, for example the higher the level (eg lux) of the ambient light, the higher the voltage of the light control signal LS1. The light sensor 180 is operatively coupled to the processor 103 which receives the light control signal LS1 and may use this to measure the intensity level (flux) or other parameters of the ambient light.

The processor 103 is arranged to forward an image signal to one of the homochromatic LCD driver 150 or the color LCD driver 160 dependent on the light control signal LS1. Thus an image is only generated on one of the LCDs 155 or 165 by the image signal. Thus for example the processor may be arranged to forward an image signal generated by the processor 103 to the homochromatic LCD driver 150 when the level of ambient light incident on the light sensor 180, as indicated by the light control signal LS1, is above a predetermined level. This predetermined level of ambient light may correspond to direct sunlight on the viewing surface of the display assembly 105. In this configuration, the display of images is switched from the color LCD 165 to the homochromatic LCD 155 when the display assembly or device itself is in direct sunlight or other high ambient lighting conditions. Homochromatic LCDs are easier to view in bright lighting conditions than color LCDs, and this arrangement automatically switches display of images from the color LCD 165 to the homochromatic LCD 155 in bright lighting conditions. This allows the user to view the display images more easily in all lighting conditions.

The use of the homochromatic LCD 155 also reduces the power consumption required for the display function of the electronics device 100, homochromatic LCDs consuming less power than equivalent color LCDs as will be appreciated by those skilled in the art.

Additionally, the processor 103 may be arranged to reduce the light output from the backlight 170 by suitably instructing the backlight driver 170 when the homochromatic LCD 155 is being driven. Homochromatic LCDs require less backlighting than equivalent color LCDs for effective viewing as will also be appreciated by those skilled in the art. This further reduces power consumption from a battery.

Whilst the homochromatic LCD 155 and the color LCD 165 may have the same resolution (for example 320×320), the homochromatic LCD 155 may have a lower resolution than the color LCD 165. For example the color LCD 165 may have a resolution of 320×320 whereas the homochromatic LCD 155 may have a resolution of 160×160. This further reduces power consumption by the homochromatic LCD 155, and may further enhance viewing in certain lighting conditions.

Figure 2A:
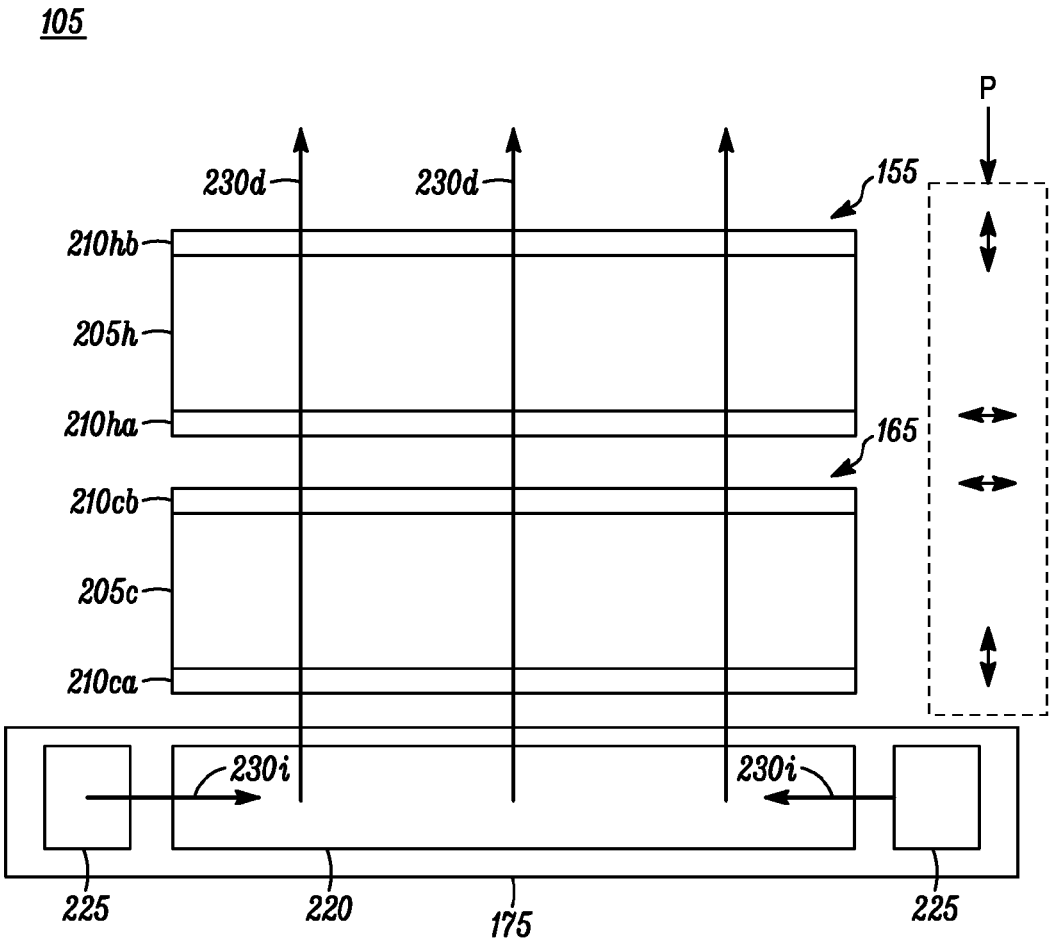
FIG. 2A is a schematic block diagram illustrating a display assembly for the electronic device of FIG. 1 and in accordance with an embodiment of the invention.
Figure 2B:
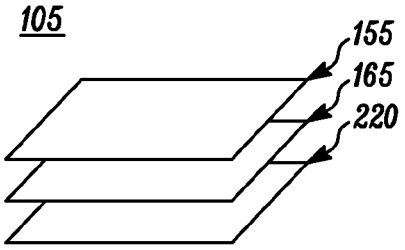
FIG. 2B is a schematic perspective view of the display assembly of FIG. 1.

FIGS. 2A and 2B show the display assembly 105 in more detail. The display assembly 105 comprises the homochromatic LCD 155, and color LCD 165, and the backlight 175. The backlight 175 comprises a light-pipe 220 and edge light sources 225. The edge light sources 225 are typically light emitting diodes (LED's) which generate a white light and are located at the sides or edges of the light-pipe 220 as shown. The edge light sources 225 are controlled by the backlight driver 170 as will be appreciated by those skilled in the art. The light-pipe is a planar lens which is designed to receive light 230*i* at its edges and to disperse or diffuse this light evenly in a perpendicular direction 230*d* as will be appreciated by those skilled in the art.

The homochromatic LCD 155, the color LCD 165, and the light-pipe 220 are arranged in overlapping relation to each other as can be seen. Thus these three planar devices (155, 165, 220) are located in parallel planes, spaced apart from each other, but overlapping in a direction perpendicular to their respective planes specifically shown in perspective view in detail in FIG. 2B. Typically the three planar devices (155, 165, 220) will have substantially similar planar dimensions and be arranged to fully overlap each other as shown, so that their respective planar profiles correspond with each other in the direction of the diffused light 230*d*. Other arrangements are also contemplated however, for example the color LCD 165 may be larger or smaller than the homochromatic LCD 155. As can be seen the diffused light 230*d* from the light-pipe passes through both the color LCD 165 and the homochromatic LCD 155. In the embodiment shown, the color LCD 165 is positioned between the homochromatic LCD 155 and the light-pipe 220; although alternatively the homochromatic LCD 155 could be positioned between the light-pipe 220 and the color LCD 165.

As will be appreciated by those skilled in the art, LCDs operate by blocking light passing through them at individual pixels in order to generate an image. When no image is being generated, LCDs allow light to pass through them. Thus when one of the homochromatic LCD 155 or the color LCD 165 is inactive (no image is being generated), light will pass through them, allowing an image to be generated on the other LCD (165 or 155).

The homochromatic LCD 155 comprises a twisted-nematic liquid crystal 205*h* sandwiched between two polarizing filters 210*ha* and 210*hb*. As will be appreciated the homochromatic LCD 155 will comprise other components such as transistors and electrodes, however these are not shown for simplicity. The polarizing directions for the two polarizing filters 210*ha* and 210*hb* are perpendicular to each other. This is indicated at P by the polarizing directions of the respective polarizing filters 210*ha*, 210*hb*, 210*ca*, 210*cb*). When inactive or with no voltage applied, the twisted-nematic liquid crystals of each pixel of the homochromatic LCD 155 twist the light they receive from the incoming polarizing filter 210*ha* by 90 degrees, so that it has the same polarization direction as the outgoing polarizing filter 210*hb*. Thus the diffused light (230*d*) received by the homochromatic LCD 155 passes through the twisted-nematic liquid crystal 205*ha* and the two polarizing filters 210*ha*, 210*hb* when the homochromatic LCD 155 is inactive. When a voltage is applied to the twisted-nematic liquid crystals of respective pixels in order to generate an image, the twisting of the light's polarization is changed, either partially or fully blocking the passage of this backlight 230*d* and generating part of the image.

Similarly, the color LCD 165 comprises a twisted-nematic liquid crystal 205*c* sandwiched between two polarizing filters 210*ca* and 210*cb*. In addition to components of the homochromatic LCD 155, the color LCD 165 also typically comprises three color filters (not shown) for three respective subpixels of each pixel as will be appreciated by those skilled in the art. The polarizing directions for these two polarizing filters 210*ca* and 210*cb* are perpendicular as indicated at P.

When inactive or with no voltage applied, the twisted-nematic liquid crystals of each pixel of the color LCD 165 twist the light they receive from the incoming polarizing filter 210*ca* by 90 degrees, so that it has the same polarization direction as the outgoing polarizing filter 210*cb*. Thus the light (230*d*) received by the color LCD 165 passes through the twisted-nematic liquid crystal 205*ca* and the two polarizing filters 210*ca*, 210*cb* when the color LCD 165 is inactive. In order that the diffused light 230*d* may pass through both the color LCD 165 and the homochromatic LCD 155, the polarizing directions of their respective polarizing filters 210*ha*, 210*hb*, 210*ca*, 210*cb* should be properly aligned. The two polarizing filters 210*ha* and 210*cb* adjacent to each other are arranged to have the same polarizing direction as shown. Thus the incoming polarizing filter 210*ha* for the homochromatic LCD 155 has a horizontal polarization direction, and the outgoing polarizing filter 210*cb* for the color LCD 165 also has a horizontal polarization direction.

Figure 3:
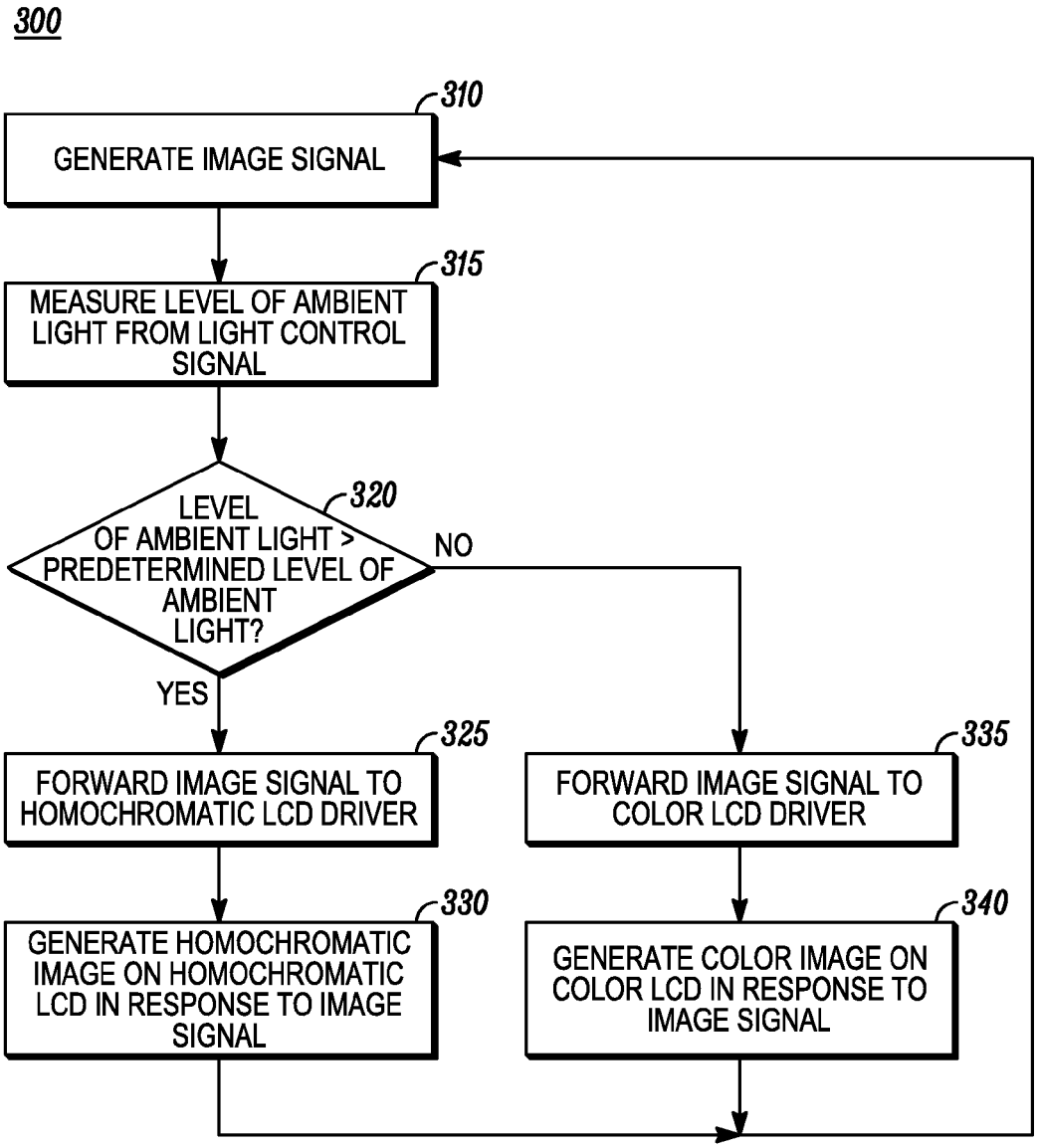
FIG. 3 is a flow diagram illustrating a method of operating a display assembly of the electronic device of FIG. 1 in accordance with one embodiment of the invention.

FIG. 3 illustrates a flow chart illustrating a method 300 operating the display assembly 105 of the electronic device 100 in order to control which LCD (155 or 165) generates an image. The processor 103 generates an image signal at a step 310. The image signal may correspond to any suitable image for display by the device 100, including for example a picture, an email, a webpage, a phone number. The processor 103 then measures the level of ambient light at the device 100 from a light control signal (LS1) at a step 315, the light control signal LS1 is generated from the light sensor 180 in response to sensing ambient light around the device 100. For example the processor 103 may measure the voltage of the light control signal LS1 and compare this with a lookup table of previously determined ambient light levels (eg lux) obtained experimentally. The levels of various other ambient light parameters may alternatively or additionally be measured. For example the intensity (lux) levels of a number of wavelengths of the incident ambient light may be measured in order to generate a wavelength profile which can then be compared to a similar profile for natural light, as opposed to fluorescent lighting.

This configuration then provides an indication of whether the device is inside under fluorescent lighting or outside under the sun.

The processor 103 then determines whether the level of ambient light is above a predetermined level of ambient light at step 320. The predetermined level of ambient light may correspond with direct sunlight at the light sensor 180 and may have been determined experimentally. If the level of ambient light is above the predetermined level of ambient light (320Y), the processor 103 forwards the image signal to the homochromatic LCD driver 150 at a step 325. The homochromatic LCD driver 150 generates a homochromatic image on the homochromatic LCD 155 in response to the image signal at a step 330. If at step 320 the level of ambient light is not above the predetermined level of ambient light (320N), the processor 103 forwards the image signal to the color LCD driver 160 at a step 335. The color LCD driver 160 generates a color image on the color LCD 165 in response to the image signal at a step 340.

The method 300 provides for generating an image on the display assembly 105, the image being homochromatic or color depending on the level of ambient light. For example, when the device 100 is taken outside into direct sunlight, the method 300 automatically switches the display assembly 105 from the color LCD 165 to the homochromatic LCD 155, and vice versa. As mentioned previously, this makes the image generated by the display assembly 105 easier to view in differing lighting conditions. It also reduces power consumption when a high power consumption viewing mode (color LCD 165) will not enhance image viewing. After effecting either step 330 or 340 the method 300 returns to step 310 so that if ambient light conditions change method 300 automatically switches the display assembly 105 from the color LCD 165 to the homochromatic LCD 155, and vice versa.

Figure 4:
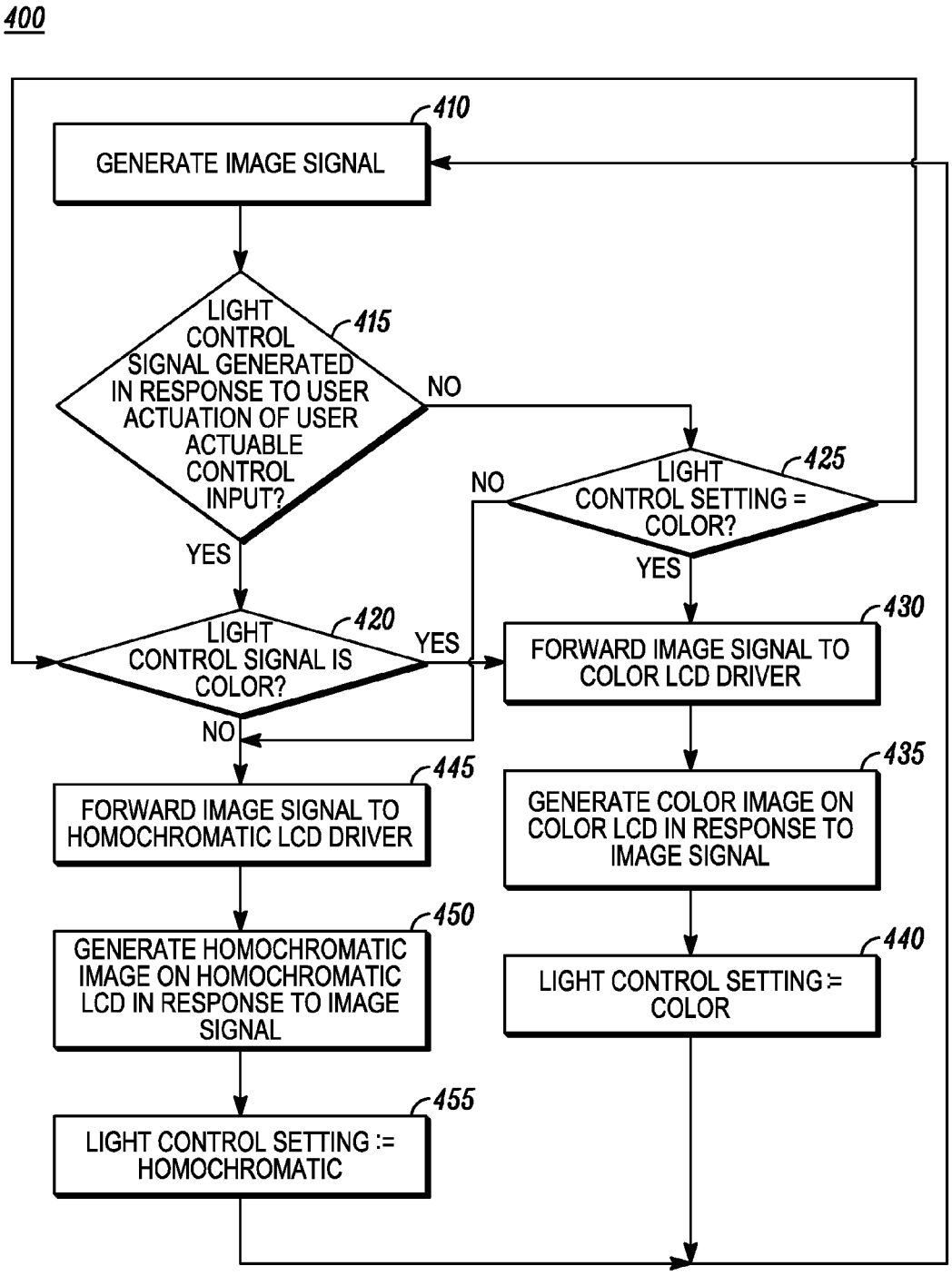
FIG. 4 is a flow diagram illustrating another method of operating a display assembly of the electronic device of FIG. 1 in accordance with another embodiment of the invention.

In FIG. 4 there is a flow chart illustrating another method 400 for operating the display assembly 105 of the electronic device 100 in order to control which LCD (155 or 165) generates an image. Similar to what is described above, the processor 103 generates an image signal at a step 410. The processor 103 monitors for a user actuated light control signals LS2 at step 415. The user actuated light control signal LS2 is generated by user actuation of a user actuable control input. The user actuable control input may be a dedicated or programmable key on the keypad 106, a soft key provided on the display assembly 105, or a menu control option accessible through one or more user actuable control inputs. Typically, the user actuated light control signal LS2 is generated in response to user actuation of the user actuable control input 106.

If the user actuated light control signal LS2 is not determined to have been received at a test step 415, then a light control setting test is conducted at a test step 425 to determine a light control setting that is initially typically set by default to color. If the light control setting is set to color then the processor 103 forwards the image signal to the color LCD driver 160 at a step 430. Next the color LCD driver 160 generates an image on the color LCD 165 in response to the image signal at a step 435.

If the user actuated light control signal LS2 is received at step 415, then the processor 103 determines at a test step 420 if the user actuated light control signal LS2 is color or homochromatic. If the user actuated light control signal LS2 is color then the processor 103 forwards the image signal to the color LCD driver 160 at a step 430. Next the color LCD driver 160 generates an image on the color LCD 165 in response to the image signal at a step 435 and the light control setting is set to color at a step 440. Alternatively, if the user actuated light control signal LS2 is homochromatic, or if at test step 425 the light control setting is determined to be homochromatic, then the processor 103 forwards the image signal to the homochromatic LCD driver 155 at a step 445 Next the homochromatic LCD driver 150 generates an image on the homochromatic LCD 155 in response to the image signal at a step 450 and the light control setting is set to homochromatic at a step 455.

After either step 455 or step 440 the method 400 returns to step 410. Thus, the user actuated light control signal LS2 acts to toggle or switch between the homochromatic LCD 155 and the color LCD 165. This may be in response to display assembly 105 glare or other ambient lighting conditions experienced by the user, or for other reasons such as a desire to reduce battery power consumption for example.

It will be apparent that methods 300 and 400 can be combined in which the user actuated light control signal LS2 overrides the light control signal LS1

In a further embodiment, user actuated light control signal LS2 may be a control signal indicating a user setting for the predetermined ambient light level at which the image is switched between the color LCD 165 and homochromatic LCD 165 in response to changes in the first light control signal 180.

The skilled person will recognise that the above-described apparatus and methods may be embodied as processor control code, for example on a carrier medium such as a disk, CD- or DVD-ROM, programmed memory such as read only memory (Firmware), or on a data carrier such as an optical or electrical signal carrier. For some applications embodiments of the invention may be implemented on a DSP (Digital Signal Processor), ASIC (Application Specific Integrated Circuit) or FPGA (Field Programmable Gate Array). Thus the code may comprise conventional programme code or microcode or, for example code for setting up or controlling an ASIC or FPGA. The code may also comprise code for dynamically configuring re-configurable apparatus such as re-programmable logic gate arrays. Similarly the code may comprise code for a hardware description language such as Verilog™ or VHDL (Very high speed integrated circuit Hardware Description Language). As the skilled person will appreciate, the code may be distributed between a plurality of coupled components in communication with one another. Where appropriate, the embodiments may also be implemented using code running on a field-(re)programmable analogue array or similar device in order to configure analogue hardware.

In the foregoing specification, specific embodiments of the present invention have been described. However, one of ordinary skill in the art appreciates that various modifications and changes can be made without departing from the scope of the present invention as set forth in the claims below. Accordingly, the specification and figures are to be regarded in an illustrative rather than a restrictive sense, and all such modifications are intended to be included within the scope of present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims including any amendments made during the pendency of this application and all equivalents of those claims.

We claim:

1. An electronic device comprising:

a homochromatic liquid crystal display;

a color liquid crystal display;

a backlight including a light-pipe;

the homochromatic liquid crystal display, the color liquid crystal display and the light-pipe being positioned in overlapping relation to each other, the light-pipe arranged to direct light through both the homochromatic liquid crystal display and the color liquid crystal display;

a homochromatic liquid crystal display driver, coupled to the homochromatic display, to generate an image on the homochromatic liquid crystal display in response to an image signal;

a color liquid crystal display driver, coupled to the color liquid display, to generate an image on the color liquid crystal display in response to an image signal;

a light sensor arranged to generate a light control signal in response to ambient light incident on the light sensor; and a processor receiving the light control signal and coupled to the homochromatic liquid crystal display driver and the color liquid crystal display driver, the processor operable to selectively provide an image signal to the homochromatic liquid crystal display driver or to the color liquid crystal display driver dependent on the light control signal, wherein the processor is arranged to forward the image signal to the homochromatic liquid crystal display driver in response to a level of ambient light incident on the light sensor being above a predetermined level and forward the image signal to the color liquid crystal display driver in response to the level of ambient light incident on the light sensor being below the predetermined level.

2. The electronic device as claimed in claim 1, wherein the color liquid crystal display is positioned between the homochromatic liquid crystal display and the light-pipe.

3. The electronic device as claimed in claim 1, wherein the processor is further arranged to forward the image signal between said homochromatic liquid crystal display driver or said color liquid crystal display driver in response to a user actuable control input.

4. The electronic device as claimed in claim 1, wherein the homochromatic liquid crystal display and the color liquid crystal display each comprise twisted-nematic liquid crystal sandwiched between two polarizing filters having perpendicular polarizing directions, the polarizing filters adjacent each other from the color liquid crystal display and the homochromatic liquid crystal display having a same polarizing direction.

5. The electronic device as claimed in claim 1, wherein the processor is further arranged to control the backlight dependent on whether the homochromatic liquid crystal display or the color liquid crystal display is being driven.

6. The electronic device as claimed in claim 1, wherein the homochromatic liquid crystal display driver and the color liquid crystal display driver are implemented by the processor.

7. A method of operating a display assembly of an electronic device, the method comprising:

measuring a level of ambient light at the device; and generating an image on the display assembly, the image being a homochromatic image when the level of ambient light is above a predetermined level or a color image when the level of ambient light is below the predetermined level, wherein the display assembly comprises a homochromatic liquid crystal display for displaying the homochromatic image and a color liquid crystal display for displaying the color image, the homochromatic liquid crystal display and the color liquid crystal display being positioned in overlapping relation to each other, wherein the display assembly further comprises a processor operable to selectively forward an image signal for generating the image to the homochromatic liquid crystal display in response to the level of ambient light being above the predetermined level and forward the image signal to the color liquid crystal display in response to the level of ambient light being below the predetermined level.

8. A method of operating a display assembly of an electronic device including a homochromatic liquid crystal display, a homochromatic liquid crystal display driver that drives the homochromatic liquid crystal display, a color liquid crystal display, and a color liquid crystal display driver that drives the color liquid crystal display, the homochromatic liquid crystal display and the color liquid crystal display carried in overlapping relation to each other, and a processor, the method comprising:

receiving by the processor a light control signal and an image signal; and providing an image signal to one of the homochromatic liquid crystal display driver that drives the homochromatic liquid crystal display that overlaps the color liquid crystal display or the color liquid crystal display driver that drives the color liquid crystal display dependent on the light control signal, wherein the image signal is provided to the homochromatic liquid crystal display driver when a level of ambient light is above a predetermined level of ambient light else provided to the color liquid crystal display when the level of ambient light is below the predetermined level of ambient light.

9. The electronic device as claimed in claim 1, wherein the homochromatic liquid crystal display comprises twisted-nematic liquid crystals and a polarizing filter, wherein the color liquid crystal display comprises twisted-nematic liquid crystals and a polarizing filter, wherein the homochromatic liquid crystal display polarizing filter is located in between the homochromatic liquid crystal display twisted-nematic liquid crystals and the color liquid crystal display polarizing filter, wherein the color liquid crystal display polarizing filter is located in between the color liquid crystal display twisted-nematic liquid crystals and the homochromatic liquid crystal display polarizing filter, and wherein the homochromatic liquid crystal display polarizing filter has a same polarizing direction as the color liquid crystal display polarizing filter.

10. The electronic device as claimed in claim 1, wherein the homochromatic liquid crystal display comprises twisted-nematic liquid crystals, a first homochromatic liquid crystal display polarizing filter, and a second homochromatic liquid crystal display polarizing filter, the twisted-nematic liquid crystals sandwiched between the first homochromatic liquid crystal display polarizing filter and the second homochromatic liquid crystal display polarizing filter, the second homochromatic liquid crystal display polarizing filter having a polarizing direction perpendicular to a first homochromatic liquid crystal display polarizing filter polarizing direction, wherein the color liquid crystal display comprises twisted-nematic liquid crystals, a first color liquid crystal display polarizing filter and a second color liquid crystal display polarizing filter, the twisted-nematic liquid crystals sandwiched between the first color liquid crystal display polarizing filter and the second color liquid crystal display polarizing filter, the second color liquid crystal display polarizing filter having a polarizing direction perpendicular to a first color liquid crystal display polarizing filter polarizing direction, and wherein one of the homochromatic liquid crystal display polarizing filters has a same polarizing direction as an adjacent color liquid crystal display polarizing filter.

11. The electronic device as claimed in claim 10, wherein the adjacent homochromatic liquid crystal display polarizing and color liquid crystal display polarizing filters are in between the homochromatic liquid crystal display twisted-nematic liquid crystals and the color liquid crystal display twisted-nematic liquid crystals.

12. The electronic device as claimed in claim 10, wherein the first color liquid crystal display polarizing filter comprises an incoming polarizing filter that receives light from the backlight, wherein the color liquid crystal display twisted-nematic liquid crystals receive light from the incoming polarizing filter, wherein the second color liquid crystal display polarizing filter comprises an outgoing polarizing filter that receives light from the color liquid crystal display twisted-nematic liquid crystals and outputs the light, and wherein the color liquid crystal display twisted-nematic liquid crystals twist the light received from the incoming polarizing filter by 90 degrees so that the light has the same polarization direction as the outgoing polarizing filter when the color liquid crystal display twisted-nematic liquid crystals are inactive.

13. The method as claimed in claim 7, wherein the homochromatic liquid crystal display comprises twisted-nematic liquid crystals and a polarizing filter, wherein the color liquid crystal display comprises twisted-nematic liquid crystals and a polarizing filter, wherein the homochromatic liquid crystal display polarizing filter is located in between the homochromatic liquid crystal display twisted-nematic liquid crystals and the color liquid crystal display polarizing filter, wherein the color liquid crystal display polarizing filter is located in between the color liquid crystal display twisted-nematic liquid crystals and the homochromatic liquid crystal display polarizing filter, and wherein the homochromatic liquid crystal display polarizing filter has a same polarizing direction as the color liquid crystal display polarizing filter.

14. The method as claimed in claim 8, wherein the homochromatic liquid crystal display comprises twisted-nematic liquid crystals and a polarizing filter, wherein the color liquid crystal display comprises twisted-nematic liquid crystals and a polarizing filter, wherein the homochromatic liquid crystal display polarizing filter is located in between the homochromatic liquid crystal display twisted-nematic liquid crystals and the color liquid crystal display polarizing filter, wherein the color liquid crystal display polarizing filter is located in between the color liquid crystal display twisted-nematic liquid crystals and the homochromatic liquid crystal display polarizing filter, and wherein the homochromatic liquid crystal display polarizing filter has a same polarizing direction as the color liquid crystal display polarizing filter.

* * * * *